US009118437B1

(12) United States Patent
Snodgrass et al.

(10) Patent No.: US 9,118,437 B1
(45) Date of Patent: Aug. 25, 2015

(54) SPATIALLY SEGMENTED ANTI-JAM ANTENNA

(71) Applicants: Timothy E. Snodgrass, Palo, IA (US); Eric O. Zuber, South Amana, IA (US); Dennis L. Hoffman, Coupeville, WA (US)

(72) Inventors: Timothy E. Snodgrass, Palo, IA (US); Eric O. Zuber, South Amana, IA (US); Dennis L. Hoffman, Coupeville, WA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 13/899,979

(22) Filed: May 22, 2013

(51) Int. Cl.
*H04K 3/00* (2006.01)

(52) U.S. Cl.
CPC ..... *H04K 3/228* (2013.01)

(58) Field of Classification Search
CPC . H04K 2203/32; H04K 2203/36; H04K 3/28; H04K 3/228
USPC ..... 455/1, 501, 63.1, 78, 101, 296, 13.3, 455/502, 63.4, 562.1, 103
See application file for complete search history.

(56) References Cited

U.S. PATENT DOCUMENTS 8,160,569 B1 * 4/2012 Vanlaningham et al. .. 455/422.1
2007/0184846 A1 * 8/2007 Horton et al. ..... 455/456.1

* cited by examiner

*Primary Examiner* — Tuan Pham
(74) *Attorney, Agent, or Firm* — Angel N. Gerdzhikov; Donna P. Suchy; Daniel M. Barbieri

(57) ABSTRACT

The present invention includes providing a multidirectional antenna unit including a plurality of directional antenna elements configured to spatially segment an operational theatre into a plurality of segmented regions, receiving radio frequency signals via the plurality of directional antenna elements from the plurality of segmented region, identifying a directional antenna element having the highest signal-to-jamming ratio, and connecting the directional antenna element having the highest signal-to-jamming ratio to a multifunction information distribution system terminal.

24 Claims, 10 Drawing Sheets

SPATIALLY SEGMENTED ANTI-JAM ANTENNA

TECHNICAL FIELD

The present invention generally relates to antenna architecture equipped with anti-jamming of capabilities and more particularly to a system and method capable of providing anti-jamming capabilities in a multidirectional antenna framework.

BACKGROUND

As the capabilities of enemy radio frequency (RF) jamming technologies continue to improve, so too does the need for improved RF anti-jamming techniques. Currently, aircraft often implement a Link 16 networking antenna for intercomputer data exchange. The current Link 16 infrastructure utilizes omnidirectional antennas to receive data transmissions from friendly aircraft. The omnidirectional antenna of current Link 16 systems provides for spherical coverage, thereby improving the real time situational awareness of the receiving system. However, the omnidirectional nature of the current Link 16 solution allows RF jamming power to be easily received by a corresponding Link 16 terminal, which is coupled to the given omnidirectional antenna. The anti-jamming capabilities of current Link 16 networks are limited to frequency hopping of the waveform and message coding gain approaches to thwart jamming attempts. Therefore, it would be advantageous to provide Link 16 based methods and systems with improved anti-jamming capabilities, thereby curing the deficiencies identified in the prior art.

SUMMARY

An apparatus for providing anti-jamming capabilities is disclosed. In one aspect, the apparatus may include, but is not limited to, a multidirectional antenna unit including a plurality of directional antenna elements configured to spatially segment an operational theatre into two or more regions; a plurality of receivers, each receiver in communication with a directional antenna element a plurality of modems, each modem in communication with a receiver and configured to correlate on a selected synchronization preamble received from the receiver; a switching element configured to selectably couple one or more of the directional antenna elements to a multifunction information distribution system terminal; and a processing unit in communication with the plurality of modems and the switching element, the processing unit configured to execute a set of program instructions suitable for causing the processing unit to direct the switching element to couple a directional antenna element in an unjammed state to the multifunction information distribution system terminal.

A method for providing anti-jamming capabilities disclosed. In one aspect, the method may include, but is not limited to, providing a multidirectional antenna unit including a plurality of directional antenna elements configured to spatially segment an operational theatre into a plurality of segmented regions; receiving radio frequency signals via the plurality of directional antenna elements from the plurality of segmented regions; identifying a directional antenna element having the highest signal-to-jamming ratio; and connecting the directional antenna element having the highest signal-to-jamming ratio to a multifunction information distribution system terminal.

In another aspect, the method may include, but is not limited to, providing a multidirectional antenna unit including a plurality of directional antenna elements configured to spatially segment an operational theatre into a plurality of segmented regions; providing an omnidirectional antenna unit; connecting the omnidirectional antenna element to a multifunction information distribution system (MIDS) terminal; transmitting MIDS transmissions via the omnidirectional antenna unit; disconnecting the MIDS terminal from the omnidirectional antenna unit; receiving radio frequency signals via the plurality of directional antenna elements from the plurality of segmented regions; identifying a directional antenna element having the highest signal-to-jamming ratio; and connecting the directional antenna element having the highest signal-to-jamming ratio to the MIDS terminal.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention. Reference will now be made in detail to the subject matter disclosed, which is illustrated in the accompanying drawings.

Referring generally to FIGS. 1A through 3, a system 100 for providing anti-jamming capabilities is described in accordance with present disclosure.

The present invention is suitable for eliminating or mitigating the impact of RF jamming techniques on an antenna receiving transmissions from a desired transmitting node. The present invention provides anti-jamming features via a multidirectional antenna unit configured to segment a given operational theatre into multiple segments, or sectors. In addition, the present invention acts to identify an "unjammed" portion of the segmented operational theatre, allowing processing circuitry and switching circuitry to couple a directional element associated with the given segment to a multifunction information distribution system (MIDS). Further, the present invention provides improved anti-jamming capabilities in a manner allowing for backward compatibility to existing network infrastructures, such as Link 16 networks, without the need to alter a platform's mission computer or multifunction information distribution system (MIDS). While it is noted herein that the present invention may be extended to various protocols and architectures, the present disclosure focuses on a Link 16 network embodiment of the present invention. It is further noted, however, that the present invention is not limited to Link 16 networking and may be extended to other communication protocols.

Figure 1A:
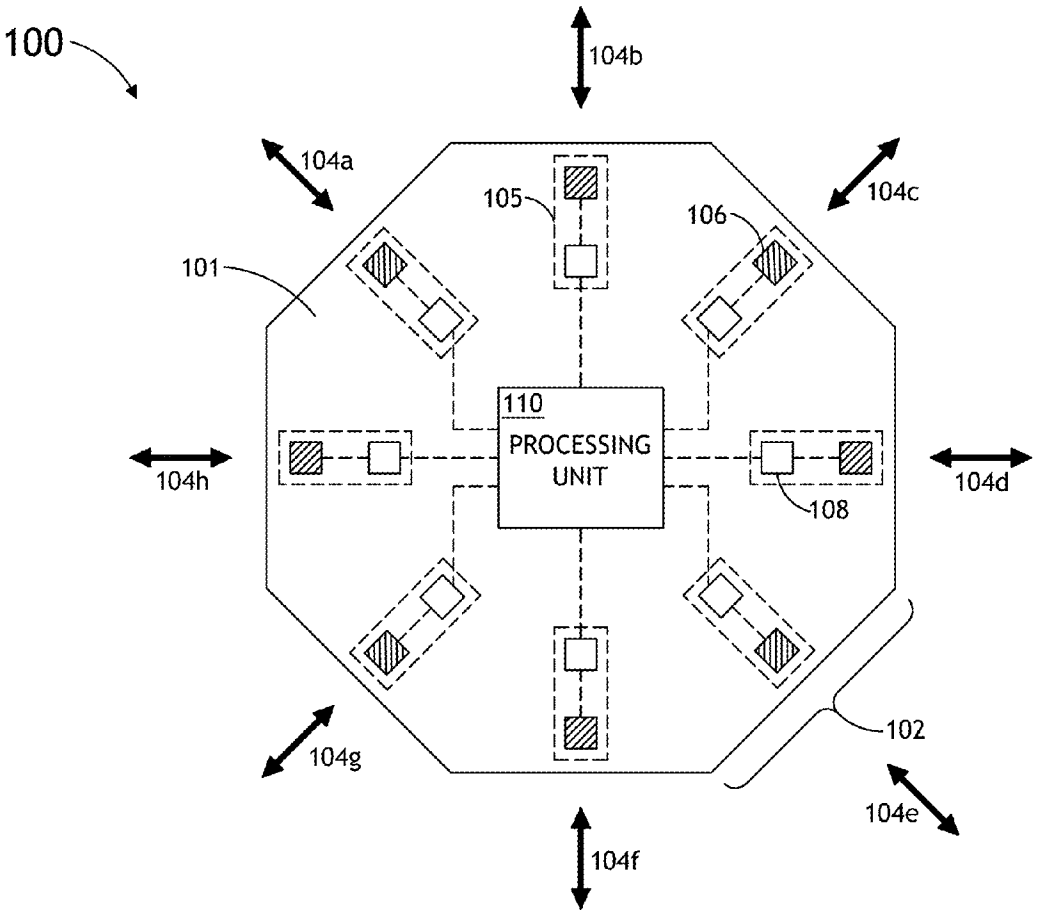
FIG. 1A is a schematic view of a multidirectional antenna unit of the anti-jamming system, in accordance with one embodiment of the present invention.
Figure 1B:
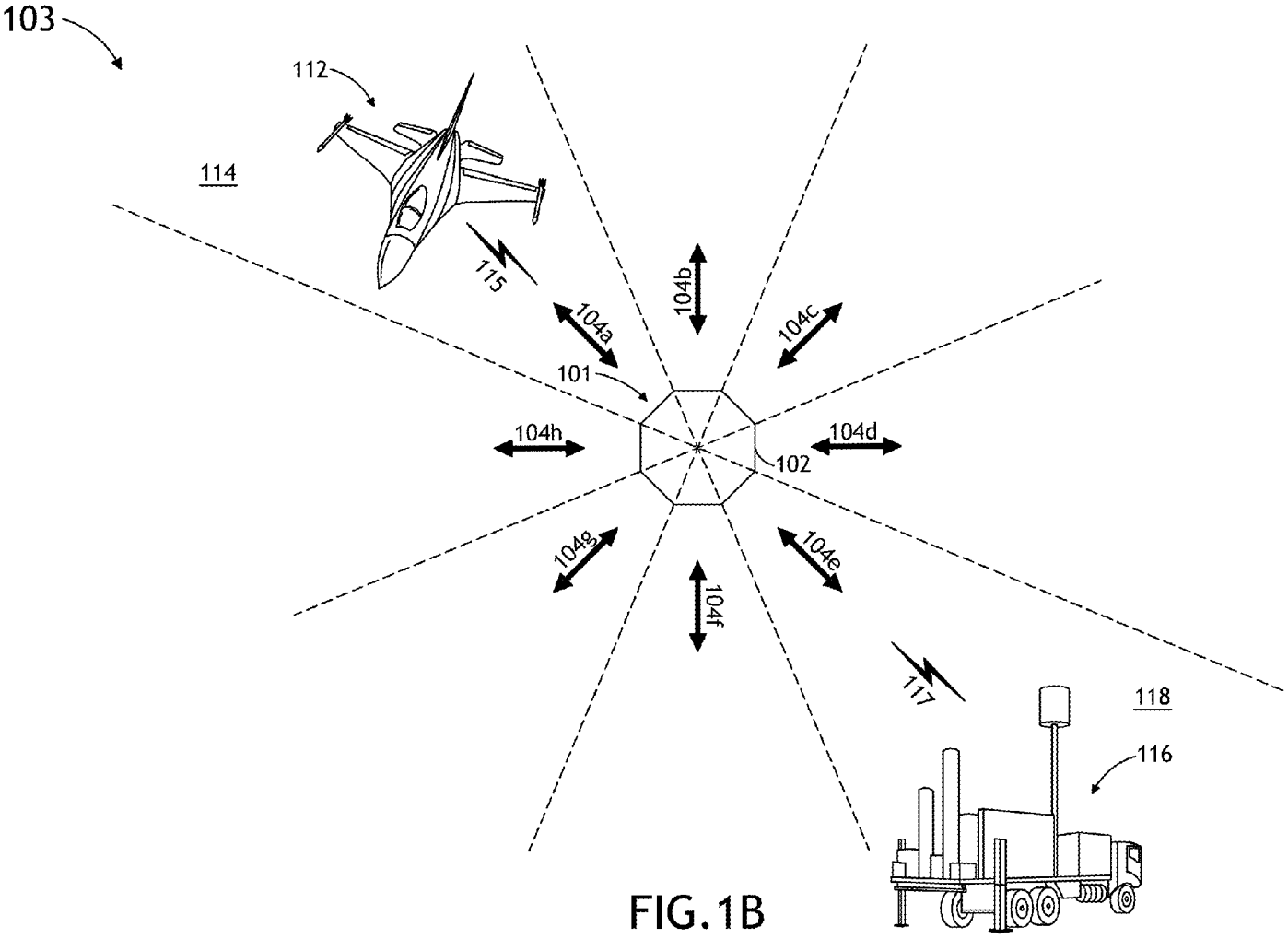
FIG. 1B is a schematic view of a segmented operational theatre created by the multidirectional antenna unit of the anti-jamming system, in accordance with one embodiment of the present invention.
Figure 1C:
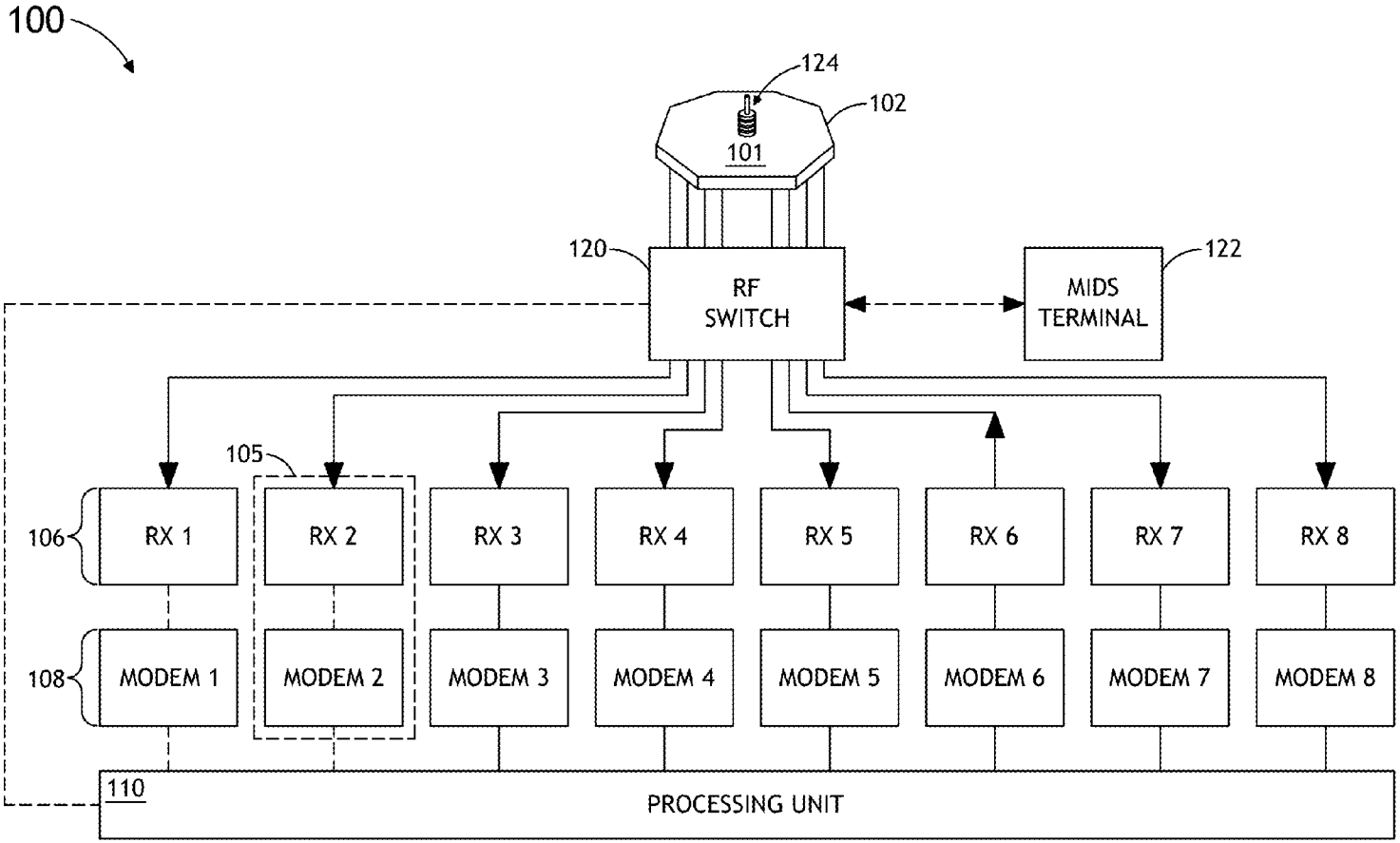
FIG. 1C is a block diagram view of the anti-jamming system, in accordance with one embodiment of the present invention.

FIGS. 1A-1C illustrate high level schematic diagrams of the anti-jamming system 100, in accordance with one embodiment of the present invention. In one aspect, the anti-jamming system 100 includes a multidirectional antenna unit 101. The multidirectional antenna unit 101 may include a set of directional antenna elements 102. In one embodiment, each directional antenna element 102 is oriented along a selected direction (e.g., directions 104*a*-104*h*) so as to spatially segment an operational theatre 103 into two or more regions in order to receive RF signals transmitted from a desired node (i.e., a "friendly" transmitter) located in a given region. In another aspect, the anti-jamming system 100 includes a plurality of receiver front ends 105 (e.g., RF receiver front ends). As shown in FIG. 1A, each front end 105 is associated with one of the directional antenna elements 102. Each receiver front end 105 may include a receiver 106 (e.g., RF receiver) and a modem 108 for processing the received signal for each antenna element 102. As shown in FIG. 1A, each directional antenna element 102 is associated with a dedicated receiver 106 and a corresponding modem 108.

In this regard, each modem 108 is configured to receive one or more signals from a different spatial region of the operational theatre 103 via the receivers 106 coupled to the directional antenna elements 102. The set of directional antenna elements 102 act to spatially segment the given operational theatre (e.g., battle space), whereby transmissions from a desired transmission node are spatially isolated from other segments, including segments containing RF jamming devices. For example, as shown in FIG. 1B, the directional antenna elements 102 serve to spatially segment the theatre 103, or battle space, into a set of regions defined by directions 104*a*-104*h*. This spatial segmentation acts to spatially isolate transmissions 115 from a desired transmission node 112, such as a friendly aircraft, contained with region 114 from other spatial regions of the active theatre, including region 118, wherein jamming signals 117 are transmitted from an enemy jamming device 116 toward the receiving antenna unit 101. It is noted herein that the segmentation of the operational theatre 103 is beneficial because RF jamming devices are not generally able to cover the required space needed to jam all directional elements 102 of the multidirectional unit 101.

In another aspect, each of the set of modems 108 is configured to correlate on a synchronization preamble received from an associated receiver 106. Then, one or more processing units 110 of the anti-jamming system 100 may direct a switching element 120 to couple a directional aperture element in an unjammed state to a multifunction information distribution system (MIDS). It is noted herein that the present invention may provide both antenna gain to the desired signal (e.g., approximately 10 dB), while providing approximately a significant amount of rejection (e.g., 25 to 30 dB) outside the coverage area of the active directional element. It is further noted that this performance improvement may substantially improve MIDS Terminals anti-jamming without altering the terminal or the mission computer OFP.

As shown in FIG. 1C, the switching element 120 of the anti-jamming system 100 is configured to selectably couple one or more of the directional antenna elements 102 to a multifunction information distribution system terminal 124. In one embodiment, the switching element 120 (e.g., RF switching element) is connected between the output of the directional antenna elements 102 of the multidirectional antenna unit 101 and the MIDS terminal 122 and configured to selectably couple a selected directional antenna element output to the MIDS terminal 122. In a further embodiment, the switching element 120 is configured to selectably couple a directional antenna element output to the MIDS terminal 122 in response to the processing unit 110.

In another embodiment, the switching element 120 may selectably couple and decouple the MIDS 122 to and from the directional antenna units 102 of the multidirectional antenna unit 101. In another embodiment, the switching element 110 may selectably couple and decouple the MIDS 122 to and from an omnidirectional antenna element 124 operably coupled to the multidirectional antenna unit 101. In a further embodiment, the switching element 120 may connect the omnidirectional antenna element 124 to a multifunction information distribution system terminal 122 during a transmitting state of the MIDS terminal 122. Further, during a receiving state, the switching element 120 may disconnect the multifunction information distribution system terminal 122 from the omnidirectional antenna element 124. Then, the switching element 120 may connect the multifunction information distribution system terminal 122 to the directional antenna element 102 of the multidirectional antenna unit 101 with the highest signal-to-jammed ratio. For example, in the case where the multidirectional antenna unit 101 includes eight directional antenna elements 102, the switching element 110 may include a 9-to-1 switch.

In one embodiment, the one or more processing units 110 are configured to identify at least one directional aperture element 102 in an unjammed state based on the correlation carried out by the modems 108. Then, the one or more processing units 110 may direct the switching element 110 to couple the at least one directional aperture element found to be in an unjammed state to a multifunction information distribution system terminal. In a further embodiment, an unjammed state may be identified by identifying the directional antenna element having the highest signal-to-jamming ratio, or correlation coefficient, based on the correlation by the modems 108. In this regard, the one or more processing units 110 may direct the switching element 120 to connect the directional antenna element having the highest correlation coefficient to a multifunction information distribution system (MIDS) terminal of an aircraft. In a further embodiment, the one or more processing element 110 may include a Link 16 processing element. For example, one or more Link 16 processing units 110 may direct the switching element 120 to connect the directional antenna element 102 having the highest signal-to-jamming ratio to an existing Link 16 terminal of the receiving aircraft. Further, the Link 16 processing unit 110 may be equipped with cryptography and "red" message processing capabilities. Those skilled in the art should recognize that such processing capabilities exist in a miniature Link 16 terminal (e.g., weapons grade TacNet 1.1 terminal).

In general, the term "processor" or "processing unit" may be broadly defined to encompass any device having one or more processors, which execute instructions from a memory medium. In this sense, the one or more processing units 110 may include any microprocessor-type device configured to execute software algorithms and/or instructions. It should be recognized that the steps described throughout the present disclosure may be carried out by a single computer system or, alternatively, a multiple computer systems. Moreover, the processing unit 110 may include logic elements (e.g., FPGAs or ASICs) suitable for carrying out at least a portion of the steps described herein.

Figure 2A:
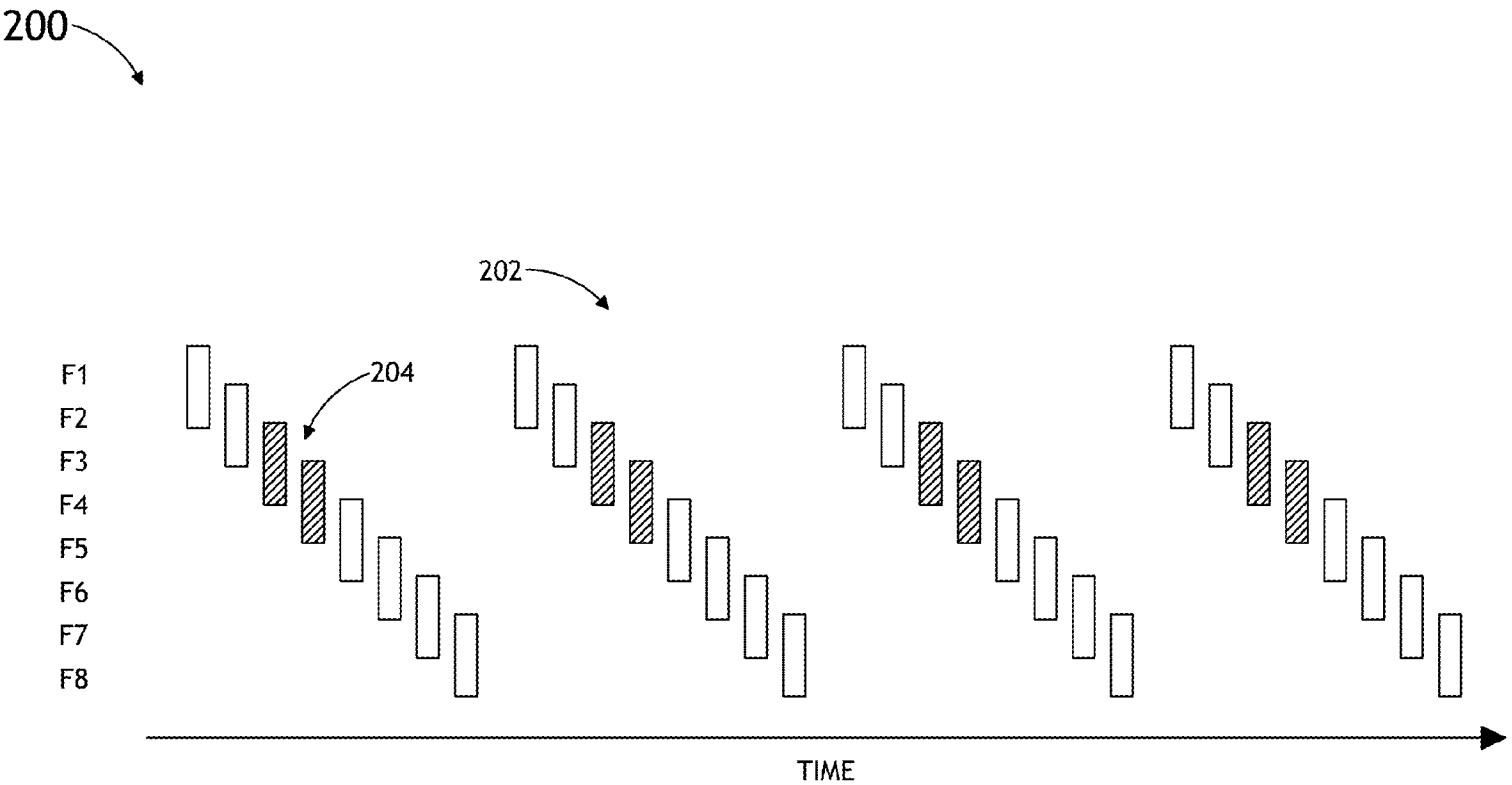
FIG. 2A is a conceptual view of the time sequence of short burst MSK modulation symbols across eight frequencies for Link 16 networking, in accordance with one embodiment of the present invention.
Figure 2B:
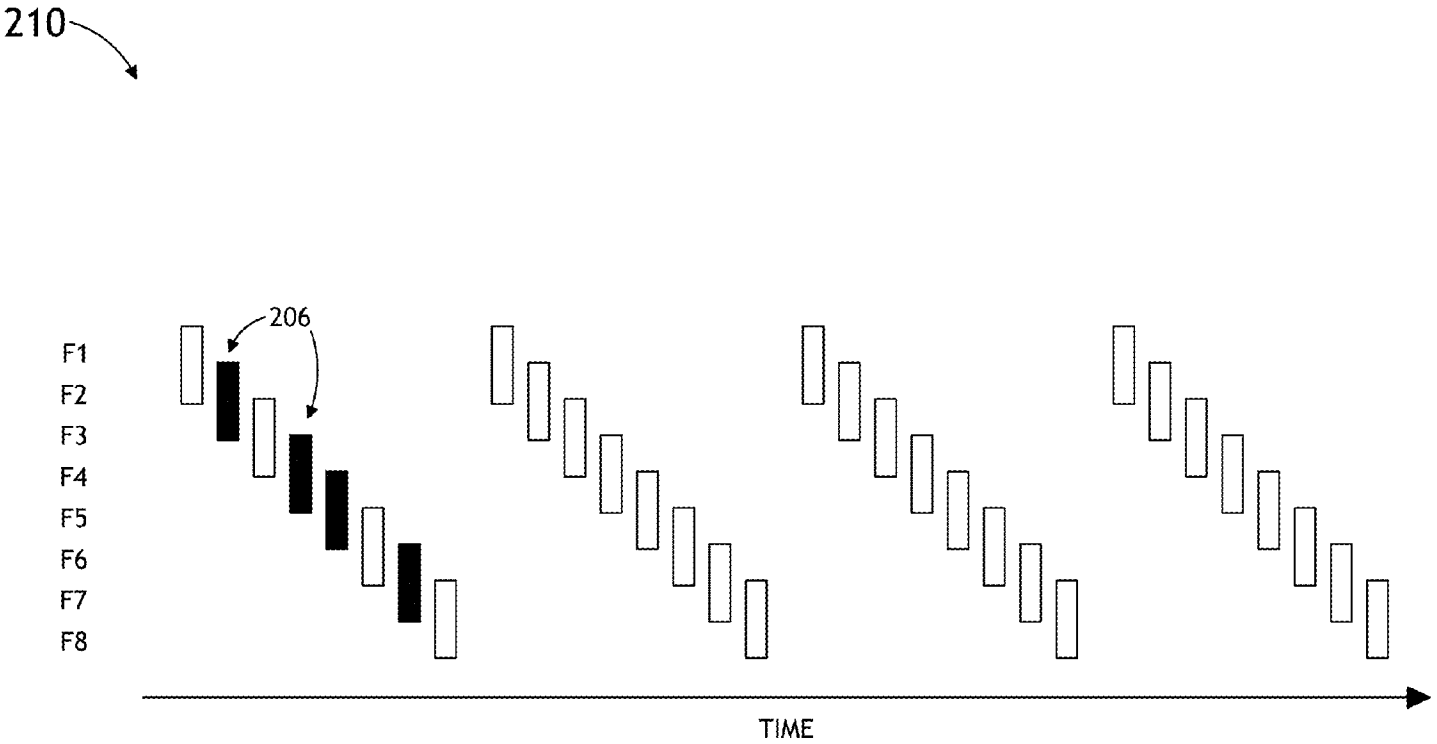
FIG. 2B is a conceptual view of the time sequence of short burst MSK modulation symbols across eight frequencies for Link 16 networking, in accordance with one embodiment of the present invention.
Figure 2C:
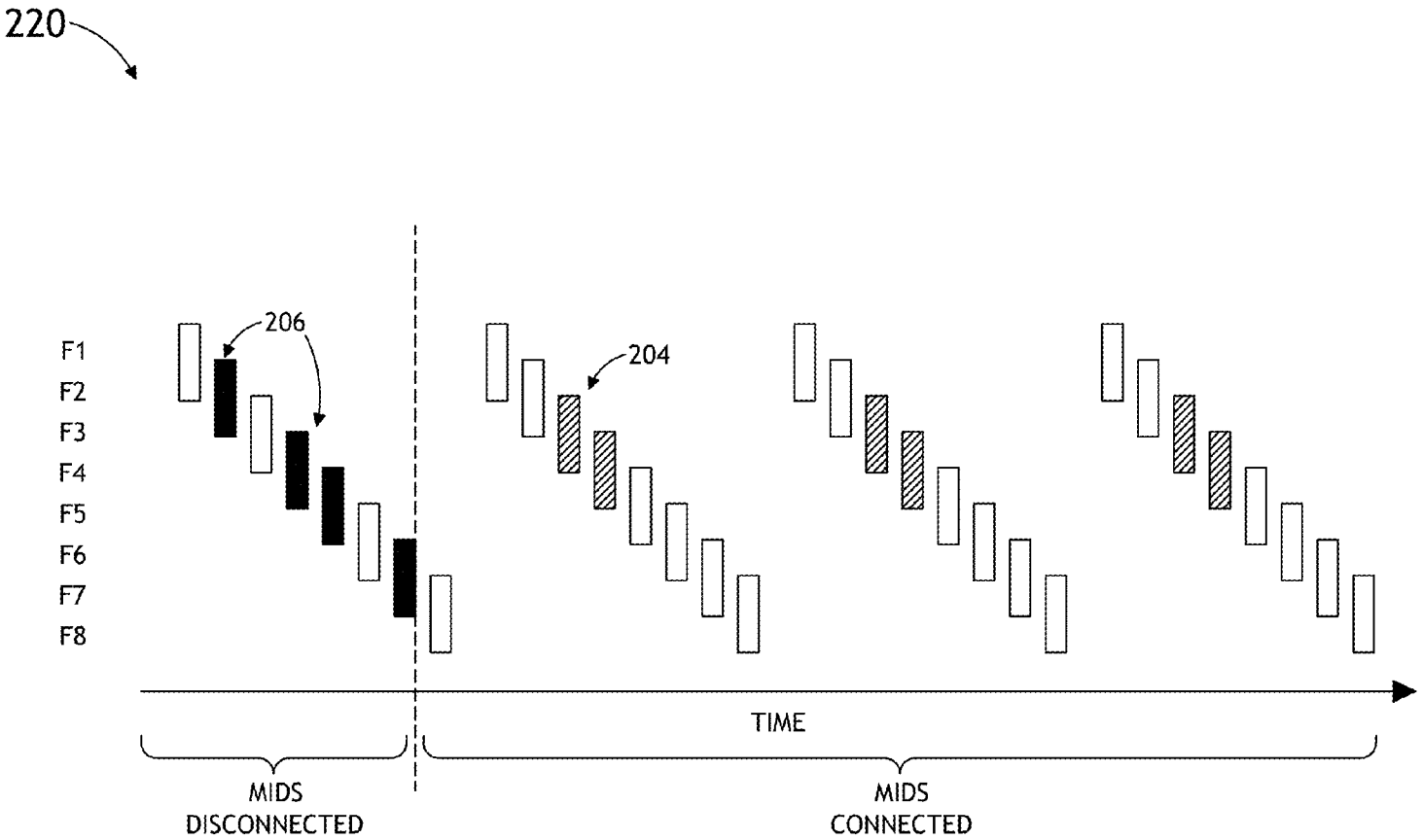
FIG. 2C is a conceptual view of the time sequence of short burst MSK modulation symbols across eight frequencies for Link 16 networking, in accordance with one embodiment of the present invention.

In one embodiment, the synchronization preamble may include a Link 16 waveform synchronization preamble. For example, the synchronization preamble may include a TRANSEC derived Link 16 waveform synchronization preamble. FIGS. 2A-2C depict a series of conceptual illustrations of the time sequence of short burst MSK modulation symbols across eight frequencies for Link 16 networking, in accordance with embodiments of the present invention. Those skilled in the art will recognize the Link 16 waveform synchronization preamble consists of 32 very short bursts of 6.4 microsecond MSK modulation symbols 202. These 32 transmitted pulses are scattered across 8 different frequencies, labeled as F1-F8 in FIGS. 2A-2C. It is noted herein that a MIDS terminal 122 needs to collect the energy from 8 of the 32 pulses in order to reach the sensitivity requirement while in a jammed state.

It is noted herein that since gain is provided by the multiple directional antenna elements 102 of the multidirectional antenna unit 101 the signal-to-noise ratio in any single directional antenna element 102 is improved. In one embodiment, it is noted that the contribution of six pulses of the multidirectional antenna unit 101 contain more signal energy than eight pulses received via a legacy omnidirectional antenna. It is further recognized herein that it does take some amount of time for the new directional antenna array to receive and despread (i.e., correlate on) the time-slot-unique TRANSEC codes. During this time, the MIDS receiver will have no signal input, which, in turn, may cause it to miss the first two pulses of the 8 it would normally receive. As shown in FIG. 2A, the shaded pulses 204 indicate that they would be the pulses collected by the MIDS receiver using the receiver's two receiver channels. As shown in FIG. 2B, in terms of time sequence, a directional antenna may receive four pulses 206 of the first sequence of eight, which are labeled as black in FIG. 2B.

As shown in FIG. 2C, once the TRANSEC correlators break a selected threshold, the modem associated with the directional element 102 yielding the highest correlation coefficient is chosen and connected to an unmodified MIDS terminal. For example, as shown in FIG. 2C, in a first step, the MIDS terminal 122 is disconnected from the directional antenna elements 102, while the directional elements 102 are correlating in order to identify the best TRANSEC/noise ratio. Once the directional element 102 having the highest signal-to-jamming ratio is identified, the MIDS is connected to the directional element 102 having the highest signal-to-jamming ratio.

It is recognized herein that in order for the antenna portion of the system 100 to be autonomous from the MIDS terminal 122 and not impact the operational flight program in the mission computer of the aircraft, the antenna itself must be able to join the Link 16 network having only 28 volt prime power supplied. As such, there must be complete Link 16 functionality running inside the radome of the antenna with the same initialization data load and cryptography keys as associated with the MIDS terminal. It is further noted that while the antenna is not required to transmit, it will be able to acquire network time via the normal process that legacy MIDS terminal use (i.e., listening for Network Entry Messages).

Further, the intelligent antenna and the MIDS terminal will both acquire "coarse synchronization" upon receiving a Net Entry Message transmitted from the Net Time Reference node. Then, the intelligent antenna may monitor for the MIDS terminal transmitting a Round Trip Timing-Interrogation (RTT-I) and will passively benefit from hearing the Round Trip Timing-Reply (RTT-R). In this manner, the antenna portion of the system 100 will gain "Fine Sync".

Figure 3A:
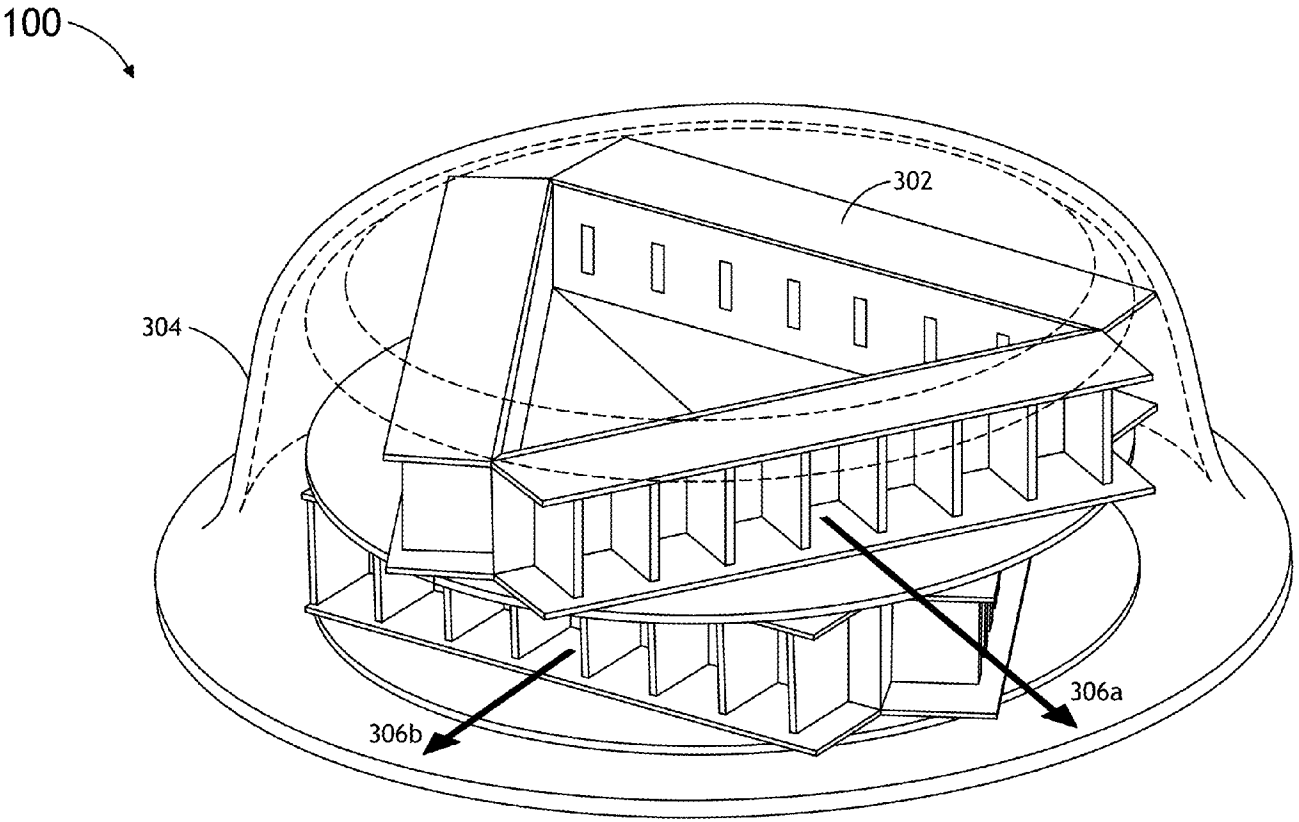
FIG. 3A is a schematic view of a multidirectional antenna unit of the anti-jamming system formed with multiple single direction antenna arrays, in accordance with one embodiment of the present invention.

FIG. 3A illustrates a multidirectional antenna unit formed from multiple single direction antenna arrays 302. In one embodiment, the multidirectional antenna unit 101 may include two or more single direction antenna arrays 302. In one embodiment, a first single direction antenna array is oriented along a first direction 306*a* and at least an additional single direction antenna array is oriented along an additional direction 306*b*. For example, as shown in FIG. 3A, the multidirectional antenna unit may include six single direction antenna arrays 302, wherein each array 302 is oriented along an independent direction. While the embodiment of FIG. 3A depicts six single direction antenna arrays 302, it is recognized herein that any number (e.g., 2, 3, 4, 5, 6, 7, 8 and so on) of single direction antenna arrays 302 may be used to form the multidirectional antenna unit 101.

Figure 3B:
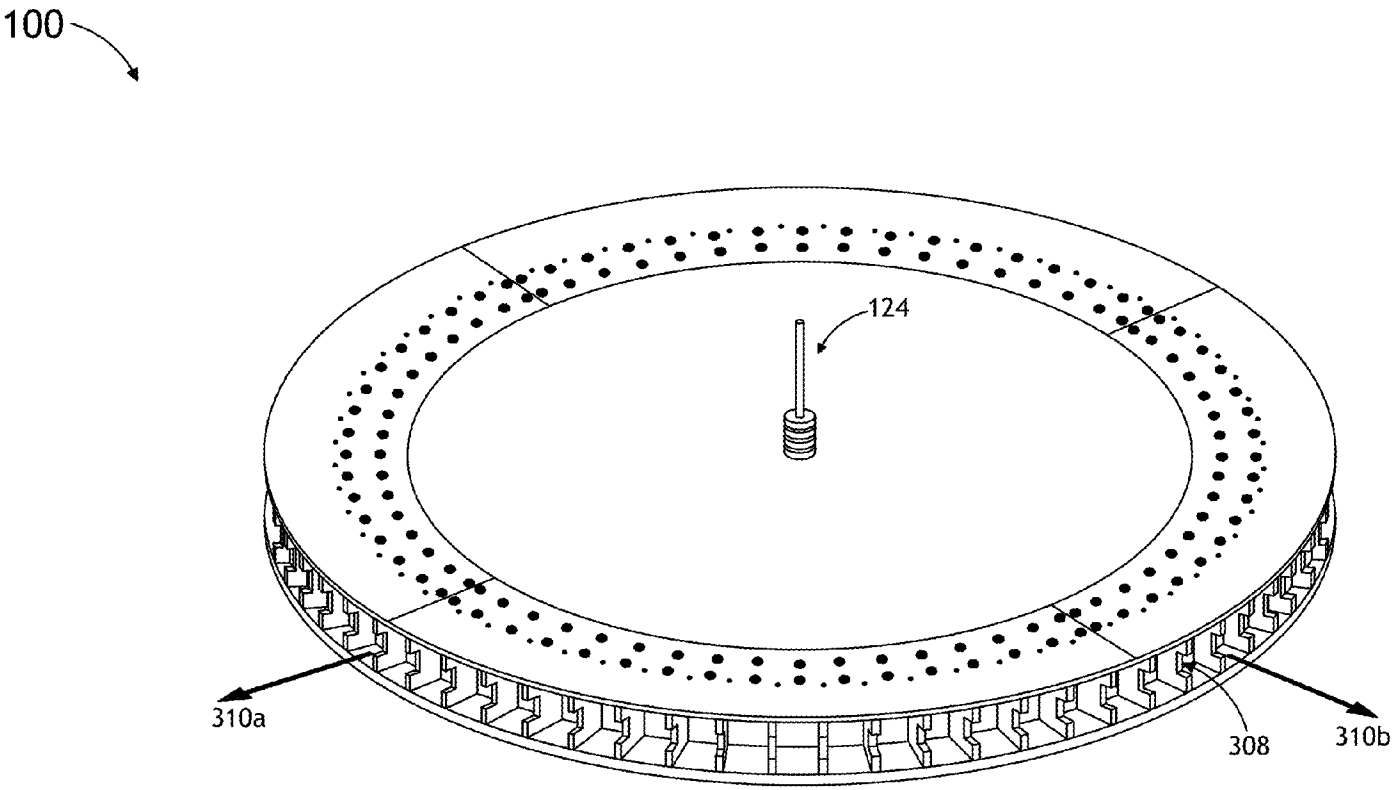
FIG. 3B is a schematic view of a multidirectional antenna unit of the anti-jamming system formed with a single multidirectional antenna, in accordance with one embodiment of the present invention.

FIG. 3B illustrates a single multidirectional array including a plurality of array elements oriented in different directions. In this regard, each array element 308 is oriented along a different direction, such as directions 310*a* and 310*b* in FIG. 3B. It is noted herein that any multidirectional array known in the art maybe suitable for implementation in the present invention. In a further embodiment, it is recognized that the directional antenna of FIGS. 3A and 3B may be operably coupled to an omnidirectional antenna element (shown in FIG. 3B). As previously described herein the omnidirectional element 124 may be utilized for transmitting by the MIDS terminal 122.

In another embodiment, the multidirectional antenna unit 101 of the system 100 may be enclosed within a radome 304. In this regard, the antenna unit 101 may be disposed on a surface of an aircraft with the radome 304 acting to enclose the antenna assembly 101 and/or additional portion of the system 100. For example, the antenna unit 101 may be disposed within a radome 304 on a top portion of an aircraft fuselage. In this regard, it is anticipated that the antenna unit 101 of the present invention may be positioned in a manner similar to the omnidirectional "blade" antennas of legacy Link 16 networks.

Figure 4:
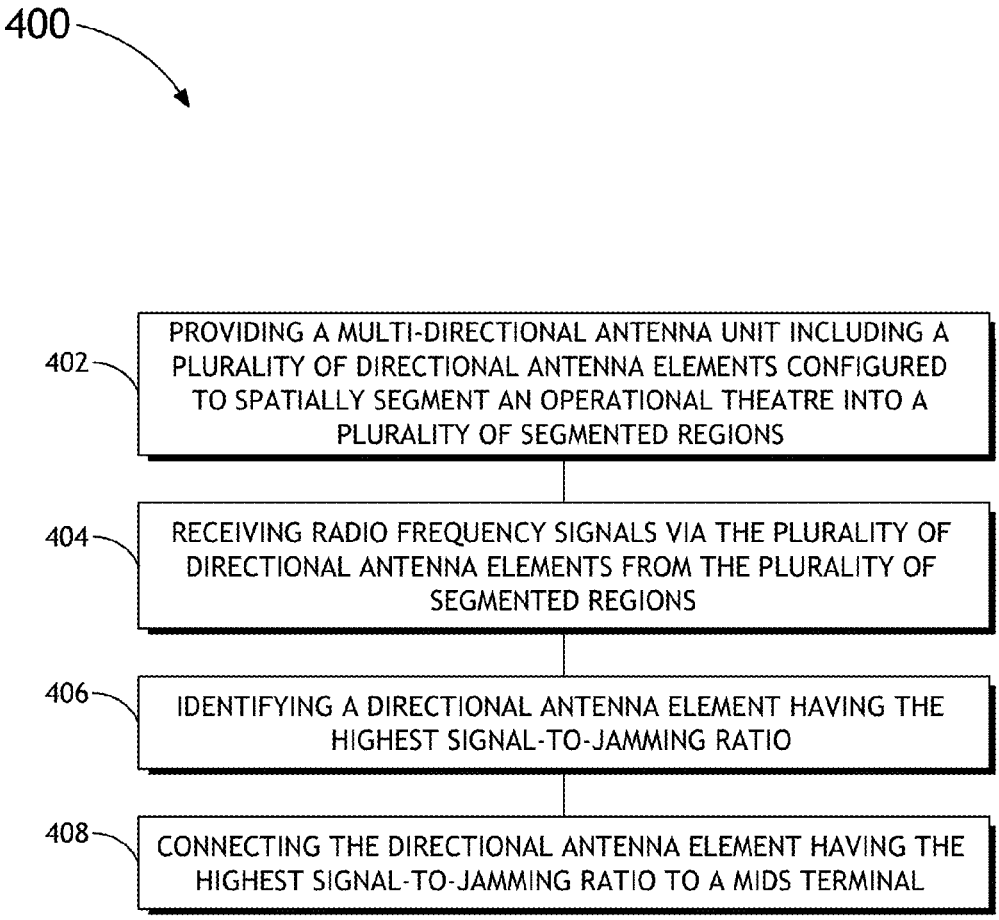
FIG. 4 is a flow diagram illustrating a method for providing anti-jamming capabilities, in accordance with an embodiment of the present invention.

FIG. 4 illustrates a process flow 400 depicting a method for providing anti-jamming capabilities. In step 402, a multidirectional antenna unit 101 including a plurality of directional antenna elements 102 configured to spatially segment an operational theatre 103 into a plurality of segmented regions is provided. In step 404, one or more radio frequency signals are received via the plurality of directional antenna elements 102 from the plurality of segmented regions. In step 406, the directional antenna element 102 having the highest signal-to-jamming ratio (i.e., correlation coefficient) is identified. In step 408, the directional antenna element having the highest signal-to-jamming ratio to is connected to a multifunction information distribution system terminal 122 of the anti-jamming system 100.

Figure 5:
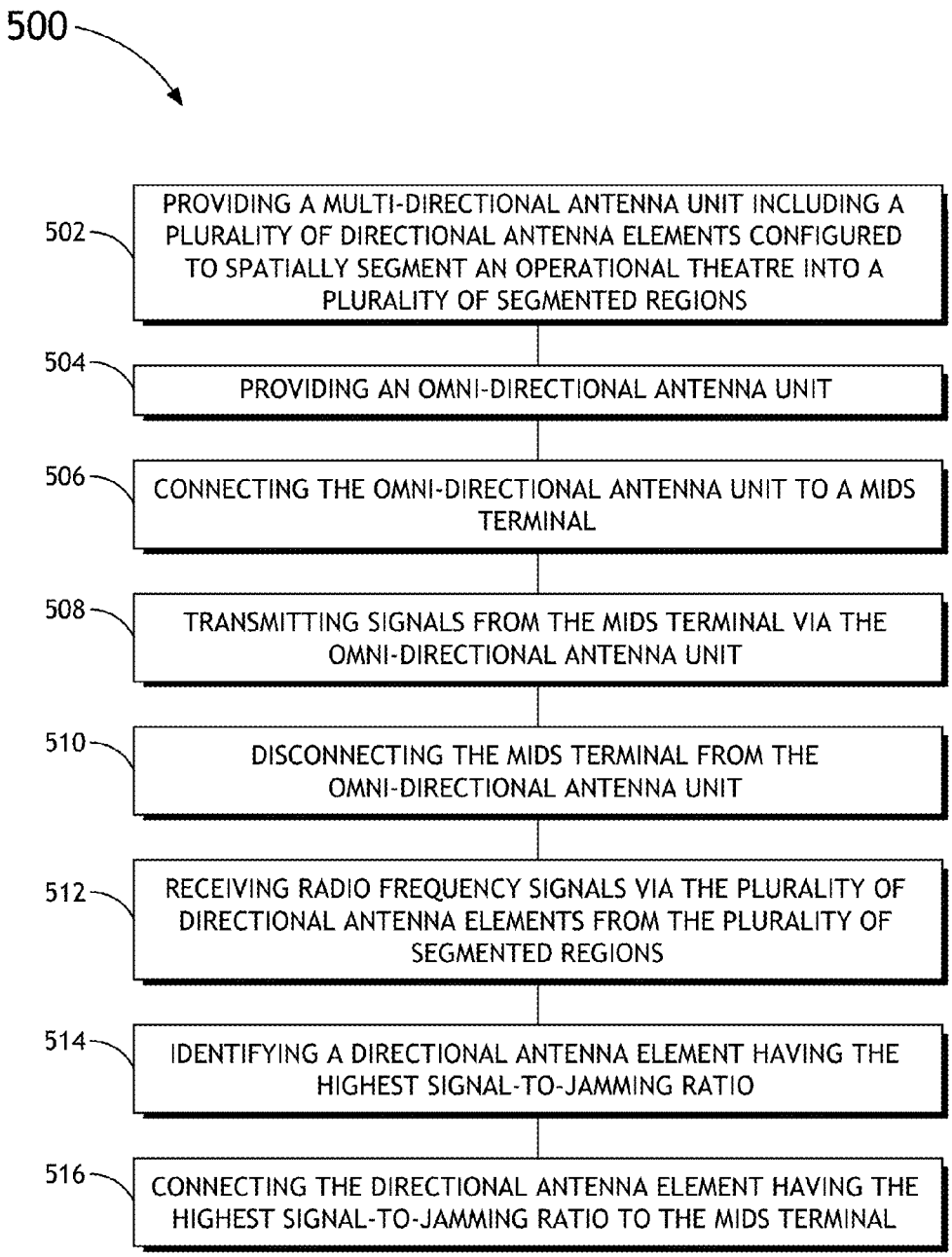
FIG. 5 is a flow diagram illustrating a method for providing anti-jamming capabilities, in accordance with an alternative embodiment of the present invention.

FIG. 5 illustrates a process flow 500 depicting a method for providing anti-jamming capabilities. In step 502, a multidirectional antenna unit including a plurality of directional antenna elements configured to spatially segment an operational theatre into a plurality of segmented regions is provided. In step 504, an omnidirectional antenna unit is provided. In step 506, the omnidirectional antenna unit is connected to a multifunction information distribution system (MIDS) terminal. In step 508, MIDS transmissions are transmitted via the omnidirectional antenna unit. In step 510, the MIDS terminal is disconnected from the omnidirectional antenna unit. In step 512, radio frequency signals are received via the plurality of directional antenna elements from the plurality of segmented regions. In step 514, the directional antenna element having the highest signal-to-jamming ratio is identified. In step 516, the directional antenna element having the highest signal-to-jamming ratio is connected to the MIDS terminal.

All of the system and methods described herein may include storing results of one or more steps of the method embodiments in a storage medium. The results may include any of the results described herein and may be stored in any manner known in the art. The storage medium may include any storage medium described herein or any other suitable storage medium known in the art. After the results have been stored, the results can be accessed in the storage medium and used by any of the method or system embodiments described herein, formatted for display to a user, used by another software module, method, or system, etc. Furthermore, the results may be stored "permanently," "semi-permanently," temporarily, or for some period of time. For example, the storage medium may be random access memory (RAM), and the results may not necessarily persist indefinitely in the storage medium.

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components and/or wirelessly interactable and/or wirelessly interacting components and/or logically interacting and/or logically interactable components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. An apparatus for providing anti-jamming capabilities comprising:

a multidirectional antenna unit including a plurality of directional antenna elements configured to spatially segment an operational theatre into two or more regions;

a plurality of receivers, each receiver in communication with a directional antenna element a plurality of modems, each modem in communication with a receiver and configured to correlate on a selected synchronization preamble received from the receiver;

a switching element configured to selectably couple one or more of the directional antenna elements to a multifunction information distribution system terminal; and a processing unit in communication with the plurality of modems and the switching element, the processing unit configured to execute a set of program instructions suitable for causing the processing unit to direct the switching element to couple a directional antenna element in an unjammed state to the multifunction information distribution system terminal.

2. The apparatus of claim 1, wherein the multidirectional antenna unit is configured to provide gain to a signal from a directional antenna element in an unjammed state.

3. The apparatus of claim 1, wherein the multidirectional antenna unit is configured to reject a signal from a directional antenna element in a jammed state.

4. The apparatus of claim 1, wherein the synchronization preamble comprises:

a Link 16 waveform synchronization preamble.

5. The apparatus of claim 1, wherein the processing unit is further configured to:

identify at least one directional antenna element in an unjammed state; and direct the switching element to couple the at least one directional aperture element in an unjammed state to a multifunction information distribution system terminal.

6. The apparatus of claim 1, wherein the processing unit is further configured to:

identify a directional aperture element having the highest correlation coefficient; and direct the switching element to couple the at least one directional antenna element having the highest correlation coefficient to a multifunction information distribution system terminal.

7. The apparatus of claim 1, wherein the correlation coefficient comprises:

a signal-to-jamming ratio.

8. The apparatus of claim 1, wherein the processing unit comprises:

a Link 16 processing unit.

9. The apparatus of claim 1, wherein the multifunction information distribution system terminal comprises:

a Link 16 multifunction information distribution system terminal.

10. The apparatus of claim 1, wherein the switching element comprises:

a RF switching element.

11. The apparatus of claim 1, wherein the multidirectional antenna unit comprises two or more single direction antenna arrays, wherein a first single direction antenna array is oriented along a first direction and at least an additional single direction antenna array is oriented along an additional direction, wherein the first direction and the additional direction are different.

12. The apparatus of claim 1, wherein the multidirectional antenna unit comprises a single multidirectional array including a plurality of array elements oriented in different directions.

13. The apparatus of claim 1, wherein the plurality of directional antenna elements includes six or more directional antenna elements.

14. The apparatus of claim 13, wherein the plurality of directional antenna elements comprises:

a first directional antenna element oriented along a first direction, a second directional antenna element oriented along a second direction, a third directional antenna element oriented along a third direction, a fourth directional antenna element oriented along a fourth direction, a fifth directional antenna element oriented along a fifth direction, and a six directional antenna element oriented along a six direction, wherein the first direction, the second direction, the third direction, the fourth direction, the fifth direction and the sixth direction are different.

15. The apparatus of claim 13, wherein the plurality of directional antenna elements includes eight or more directional antenna elements.

16. The apparatus of claim 15, wherein the plurality of directional antenna elements comprises:

a first directional antenna element oriented along a first direction, a second directional antenna element oriented along a second direction, a third directional antenna element oriented along a third direction, a fourth directional antenna element oriented along a fourth direction, a fifth directional antenna element oriented along a fifth direction, and a six directional antenna element oriented along a six direction, a seventh directional antenna element oriented along a seventh direction, an eight directional antenna element oriented along an eighth direction, wherein the first direction, the second direction, the third direction, the fourth direction, the fifth direction, the sixth direction, the seventh direction and the eight direction are different.

17. The apparatus of claim 1, further comprising:

an omnidirectional antenna element operably coupled to the multidirectional antenna unit, wherein the omnidirectional antenna element is configured to omnidirectionally transmit one or more signals from the multifunction information distribution system terminal.

18. The apparatus of claim 17, wherein the switching element is configured to connect the multifunctional information distribution system terminal to the omnidirectional antenna element during a transmitting phase.

19. The apparatus of claim 18, wherein the switching element is configured to:

disconnect the multifunctional information distribution system terminal from the omnidirectional antenna element during a receiving phase.

20. The apparatus of claim 19, wherein the switching element is configured to:

upon disconnection of the multifunctional information distribution system terminal from the omnidirectional antenna element, connect the multifunctional information distribution system terminal to an unjammed directional antenna element of the multidirectional antenna unit.

21. The apparatus of claim 17, wherein at least one of the multidirectional antenna unit and the omnidirectional antenna element are disposed on a surface of an aircraft.

22. The apparatus of claim 21, further comprising:

a radome positioned over the at least one of the multidirectional antenna unit and the omnidirectional antenna element disposed on the surface of the aircraft.

23. A method for providing anti-jamming capabilities comprising:

providing a multidirectional antenna unit including a plurality of directional antenna elements configured to spatially segment an operational theatre into a plurality of segmented regions;

receiving radio frequency signals via the plurality of directional antenna elements from the plurality of segmented regions;

correlating on a selected synchronization preamble contained within the received radio frequency signals; and connecting a directional antenna element in an unjammed state to a multifunction information distribution system terminal.

24. A method for providing anti-jamming capabilities comprising:

providing a multidirectional antenna unit including a plurality of directional antenna elements configured to spatially segment an operational theatre into a plurality of segmented regions;

providing an omnidirectional antenna unit;

connecting the omnidirectional antenna element to a multifunction information distribution system (MIDS) terminal;

transmitting MIDS transmissions via the omnidirectional antenna unit;

disconnecting the MIDS terminal from the omnidirectional antenna unit;

receiving radio frequency signals via the plurality of directional antenna elements from the plurality of segmented regions;

correlating on a selected synchronization preamble contained within the received radio frequency signals; and connecting a directional antenna in an unjammed state to the MIDS terminal.

* * * * *